US005127427A

United States Patent [19]

Kajpust et al.

[11] Patent Number: 5,127,427

[45] Date of Patent: Jul. 7, 1992

[54] DRINKING WATER FAUCET

[75] Inventors: Andrew J. Kajpust, Hanover Park; Ronald M. Matyja, Wheeling, both of Ill.

[73] Assignee: Culligan International Company, Northbrook, Ill.

[21] Appl. No.: 696,877

[22] Filed: May 8, 1991

Related U.S. Application Data

[62] Division of Ser. No. 539,150, Jun. 18, 1990, abandoned.

[51] Int. Cl.[5] ..... E03C 1/02; E03C 1/10; E03C 1/12

[52] U.S. Cl. ..... 137/216; 4/678; 137/359; 137/551; 137/801; 251/351; 210/418

[58] Field of Search ..... 4/191, 192; 137/216, 137/359, 551, 801; 251/351; 210/418

[56] References Cited

U.S. PATENT DOCUMENTS

| | | | |
|---|---|---|---|
| 853,726 | 5/1907 | Newton | 4/192 X |
| 2,561,823 | 7/1951 | Sayre | 251/155 X |
| 2,675,017 | 4/1954 | Fredrickson et al. | 4/192 X |
| 3,032,272 | 5/1962 | Nesky | 251/351 |
| 3,774,623 | 11/1973 | Mrugala | 251/155 X |
| 4,103,709 | 8/1978 | Fischer | 137/801 X |
| 4,134,419 | 1/1979 | Richetti | 137/216 |
| 4,454,891 | 6/1984 | Dreibelbis et al. | 137/216 |
| 4,635,673 | 1/1987 | Gerdes | 137/216 |
| 4,760,861 | 8/1988 | Botnick | 137/801 |
| 4,856,121 | 8/1989 | Traylor | 137/216 |
| 4,856,559 | 8/1989 | Lipshultz et al. | 137/216 |
| 4,967,784 | 11/1990 | Barhydt et al. | 137/216 |

FOREIGN PATENT DOCUMENTS

| | | | |
|---|---|---|---|
| 953019 | 11/1949 | France | 4/192 |

*Primary Examiner*—Gerald A. Michalsky
*Attorney, Agent, or Firm*—Gerstman & Ellis, Ltd.

[57] ABSTRACT

A novel drinking water faucet of the type used with household water purification system is provided. The faucet includes a spout, a valve, means for opening and closing said valve, a waste water inlet, an air gap, and a waste water outlet. The faucet includes means for accommodating the visual display of a water quality meter. The faucet can be mounted in either a right-handed or left-handed configuration from above the mounting surface.

11 Claims, 5 Drawing Sheets

Fig. 4
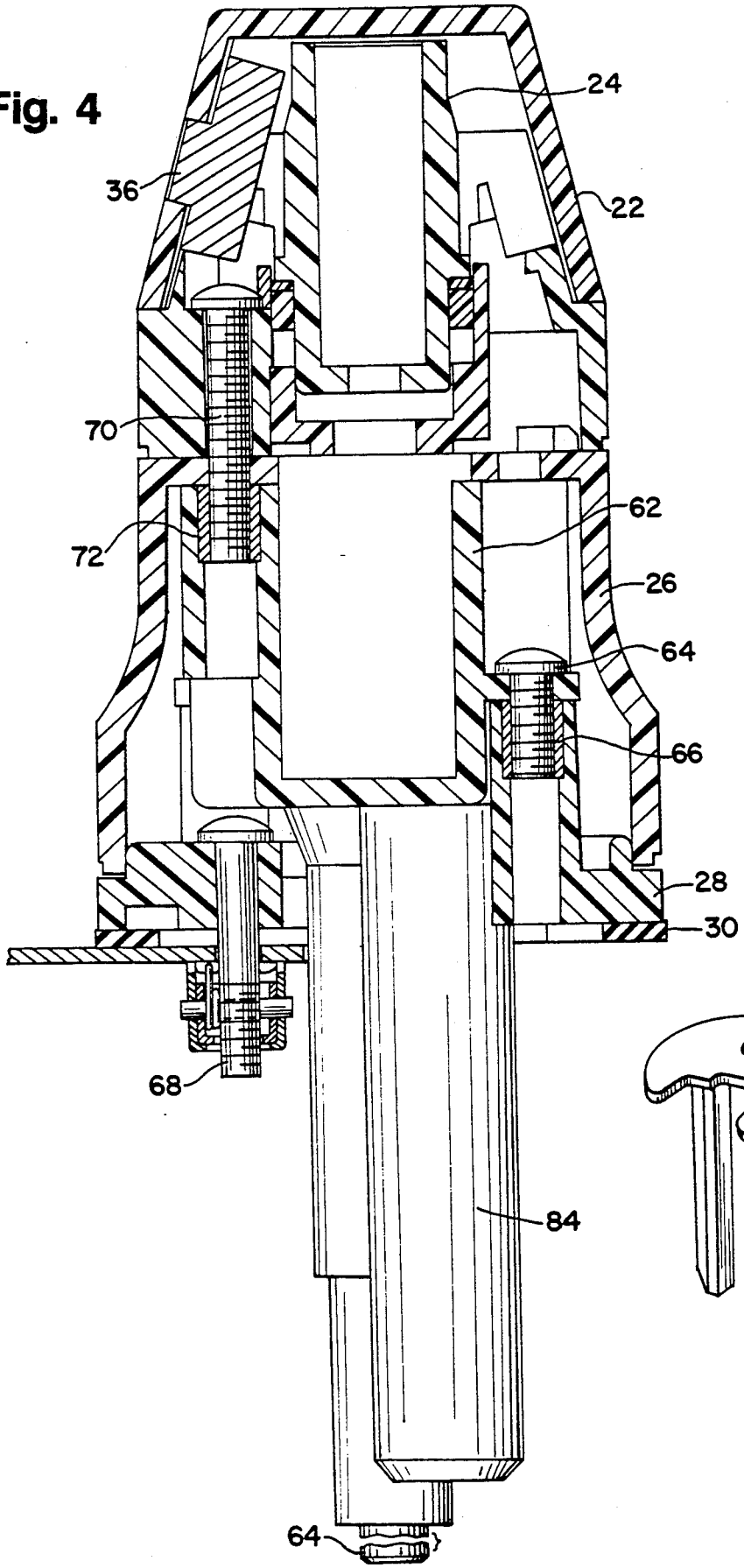
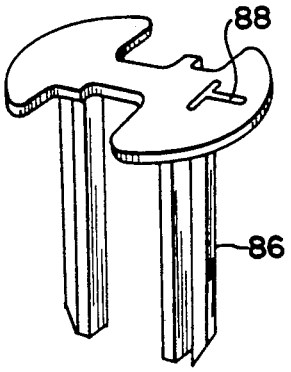
Fig. 7

DRINKING WATER FAUCET

RELATED APPLICATION

This application is a division of U.S. application Ser. No. 539,150 filed Jun. 18, 1990, now abandoned.

FIELD OF THE INVENTION

The present invention concerns a novel drinking water faucet.

BACKGROUND OF THE INVENTION

The faucet of the present invention was designed primarily for use with household water purification systems, such as reverse osmosis water purification systems. Household water purification systems are used to purify water used for drinking and cooking and the like. Many modern systems are installed below a sink and are connected to a cold water line and the sink drain of the primary plumbing system. As most household water purification systems are installed in addition to the primary plumbing systems, cost, convenience and ease of maintenance are very important.

It has been recognized that it is much more convenient, easier and quicker to install faucets from above the sink or other surface on which they are to be placed. Frequently, the area below the sink is cluttered with pipes, garbage disposal, etc. And, due to construction of the sink and placement of the faucet, it is difficult or impossible to see or reach the area in which the faucet is to be installed from below the sink. In addition, it is frequently uncomfortable to work below the sink. Accordingly, the faucet of the present invention is designed to be installed from above the sink.

Most modern household water purification systems require periodic maintenance in order to work properly. For example, reverse osmosis purification systems require periodic replacement of the semipermeable membrane through which the water passes during the purification process. An indication of the purity of the water and of the necessity for maintenance can be obtained by monitoring the content of electrically conductive material in the water being produced by the system. Therefore, the present faucet is designed to accommodate water quality monitoring apparatus.

Most modern household water purification systems require the disposal of a waste water solution. In order to dispose of this waste water solution, the water purification system is connected to a drain in the primary plumbing system which is connected to the sewer or septic system. An air gap is installed in the water purification system to prevent fluid from the sewer or septic system from backing up into or being drawn into the water purification system or fresh water system by a drop in pressure in the water purification system or fresh water system. Indeed, modern plumbing codes and regulations usually mandate that such an air gap be used. As such air gaps need to be installed above the sink, it has become common practice to design faucets for use with household water purification systems to include an air gap.

A common problem with the air gaps used in connection with household purification systems is that a gurgling noise is produced at the air gap. The instant inventors have discovered that this problem is caused by beads of water forming a moving plug in the drain line leading from the air gap and may be solved by increasing the inside diameter of the drain line leading from the air gap to the drain. It is believed that increasing the inside diameter causes the liquid to run down the side of the line and prevents plugs from forming in the line.

It is, therefore, an object of the present invention to provide a faucet that is simple in construction and economical to manufacture.

Another object of the present invention is to provide a faucet which includes an air gap which works satisfactorily to prevent contamination of the fresh water system or the water purification apparatus and which does not gurgle.

Another object of the present invention is to provide a faucet which can be mounted in either a right-handed or left-handed configuration.

Another object of the present invention is to provide a faucet which can accommodate a display for a water quality monitor.

A still further object of the present invention is to provide a faucet which can be installed from above a sink.

Other objects and advantages of the present invention will become apparent as the description proceeds.

SUMMARY OF THE INVENTION

In accordance with the present invention, a water faucet is provided which includes an outer body defining a purified water passage therein, a purified water inlet communicating with the purified water passage, a valve within the purified water passage, and an inlet spout for the purified water. The outer body defines a first aperture for receiving the outlet spout, with the aperture communicating with the purified water passage. In the illustrative embodiment, a second aperture is defined by the outer body for receiving the outlet spout. The second aperture is adapted for communication with the purified water passage. In this manner, the outlet spout can be introduced into the first aperture or the second aperture, enabling the faucet to be mounted either in a left-handed or right-handed configuration.

In the illustrative embodiment, a handle is provided for operating the valve. The handle is operatively coupled to the valve and is slidable horizontally to move the valve from a closed position to an open position.

In the illustrative embodiment, the outer body has means for containing a water quality monitor. The containing means comprise an opening defined by the outer body for receiving a water quality monitor visual display.

In the illustrative embodiment, a waste water inlet is coupled to the outer body and a waste water outlet is also coupled to the outer body. An air gap chamber couples the waste water inlet to the waste water outlet.

In the illustrative embodiment the water faucet further includes means for mounting the faucet from above a mounting surface. The mounting means comprises toggle bolts and a base mounting tool. The base mounting tool includes means for preventing the arms on the toggle bolts from rotating while the toggle bolts are tightened and means for aligning the faucet.

A more detailed explanation of the invention is provided in the following description and claims, and is illustrated in the accompanying drawings.

BRIEF DESCRIPTION OF THE DRAWINGS

FIG. 4 is a cross-sectional view, taken along the plane of the line 4—4 of FIG. 2;

FIG. 7 is a perspective view of a base mounting tool.

DETAILED DESCRIPTION OF THE ILLUSTRATIVE EMBODIMENT

Figure 1:
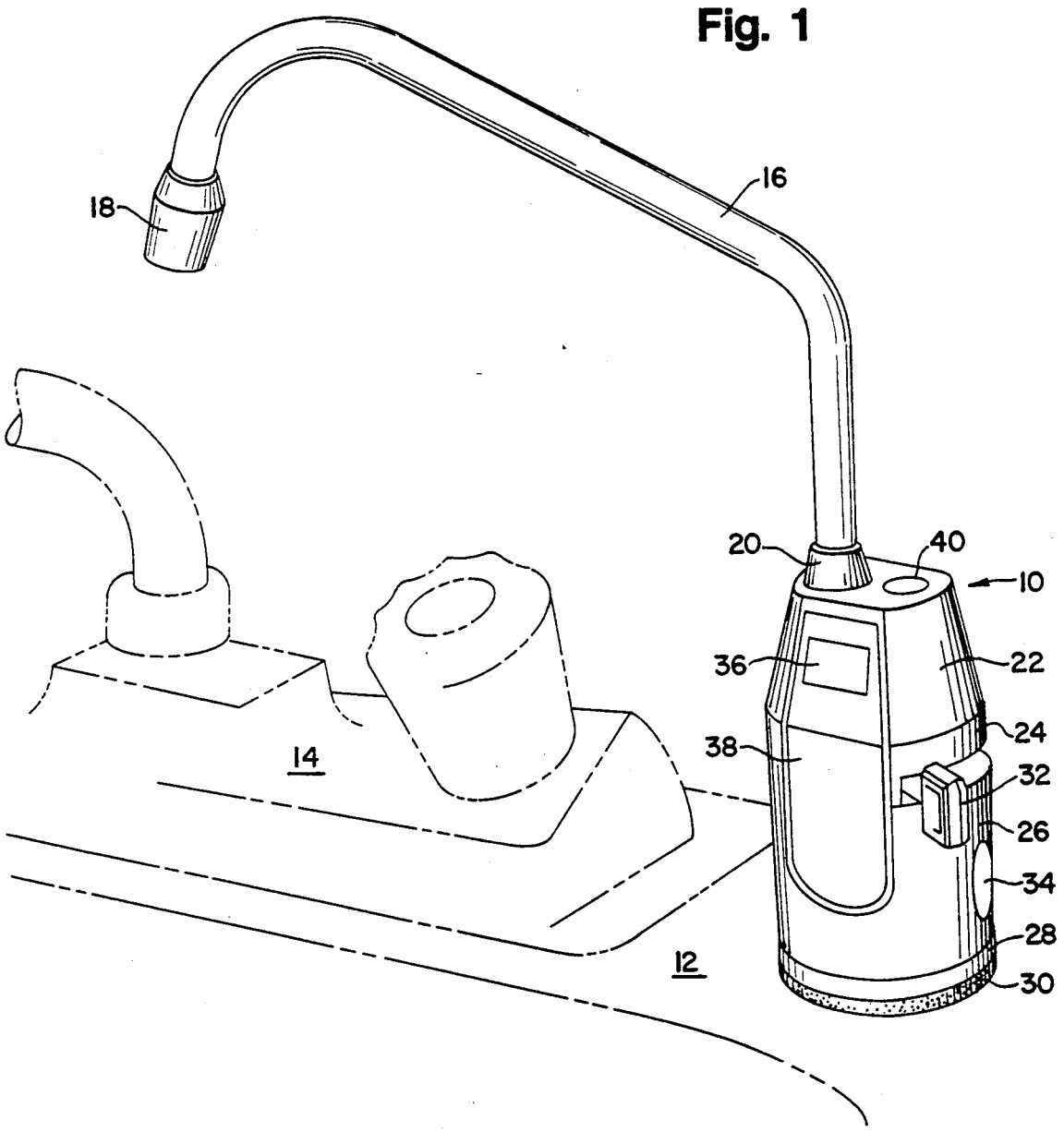
FIG. 1 is an illustration of a faucet constructed in accordance the principles of the present invention.

In FIG. 1, the faucet 10 is shown mounted on a sink 12 next to the primary faucet 14 connected directly to the primary plumbing system. The faucet 10 comprises a spout 16. It is preferably made of stainless steel. A spout tip 18 is mounted on the distal end of spout 16. It is used to prevent scratching of glasses and other receptacles into which water is dispensed. A ferrule 20 is placed around the spout 16 and rests on top of the outer body top 22. Below the outer body top 22 is the inner body top 24, outer body bottom 26, the base 28 and a gasket 30.

Extending from a slot in the inner body top 24 is an operating handle 32 which is used to turn the faucet on and off. Below the operating handle is the air gap hole 34. The display 36 for a water quality monitor is mounted in the front face of the faucet 10.

A water quality monitor of the water conductivity sensing type which is suitable for use in the faucet of the present invention is commercially available from Myron L Company, Inc., Carlsbad, Calif. The water quality monitor measures the content of electrically conductive material in the water which serves as an indication of dissolved impurities and provides an indication as to the quality of the water. In the faucets sold by the inventors' assignee, Culligan International Company, the display reads "Culligan" when the water quality is acceptable and reads "Hey Culligan Man" indicating the need for service to the water purification system when the water conductivity exceeds a preset limit.

A decal 38 is placed on the front face of the faucet. If a water quality monitor is not used, a blank may be inserted in place of the display 30 and/or a decal without an aperture for a display may be used. In addition, the outer body top 22 is designed so that the aperture for the water quality monitor may be placed towards the rear of faucet 10 if a water quality monitor is not used. To this end, the outer body top 22 has a second spout aperture 40 in its top through which the spout 16 may be placed.

Although the faucet is shown in its right hand configuration (with the operating handle 32 on the right side), it is designed so that it may also be mounted in a left hand configuration.

Figure 2:
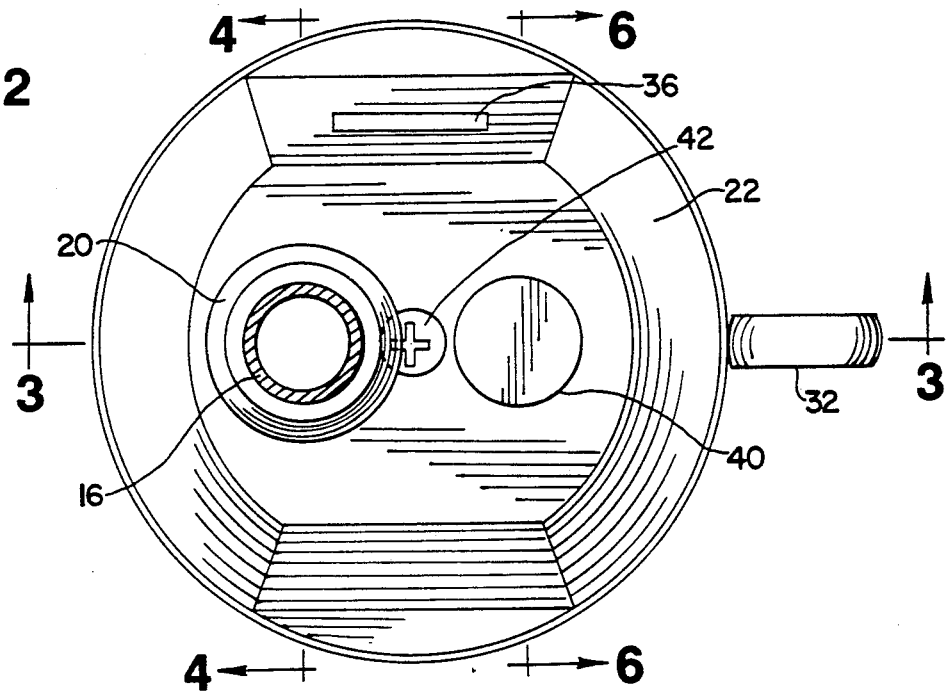
FIG. 2 is a top view, partly sectioned, of the faucet of FIG. 1.

Referring to FIG. 2, the spout 16 (sectioned), ferrule 20, outer body top 22, second spout aperture 40, screw 42, visual display 36, and operating handle 32 are shown.

Figure 3:
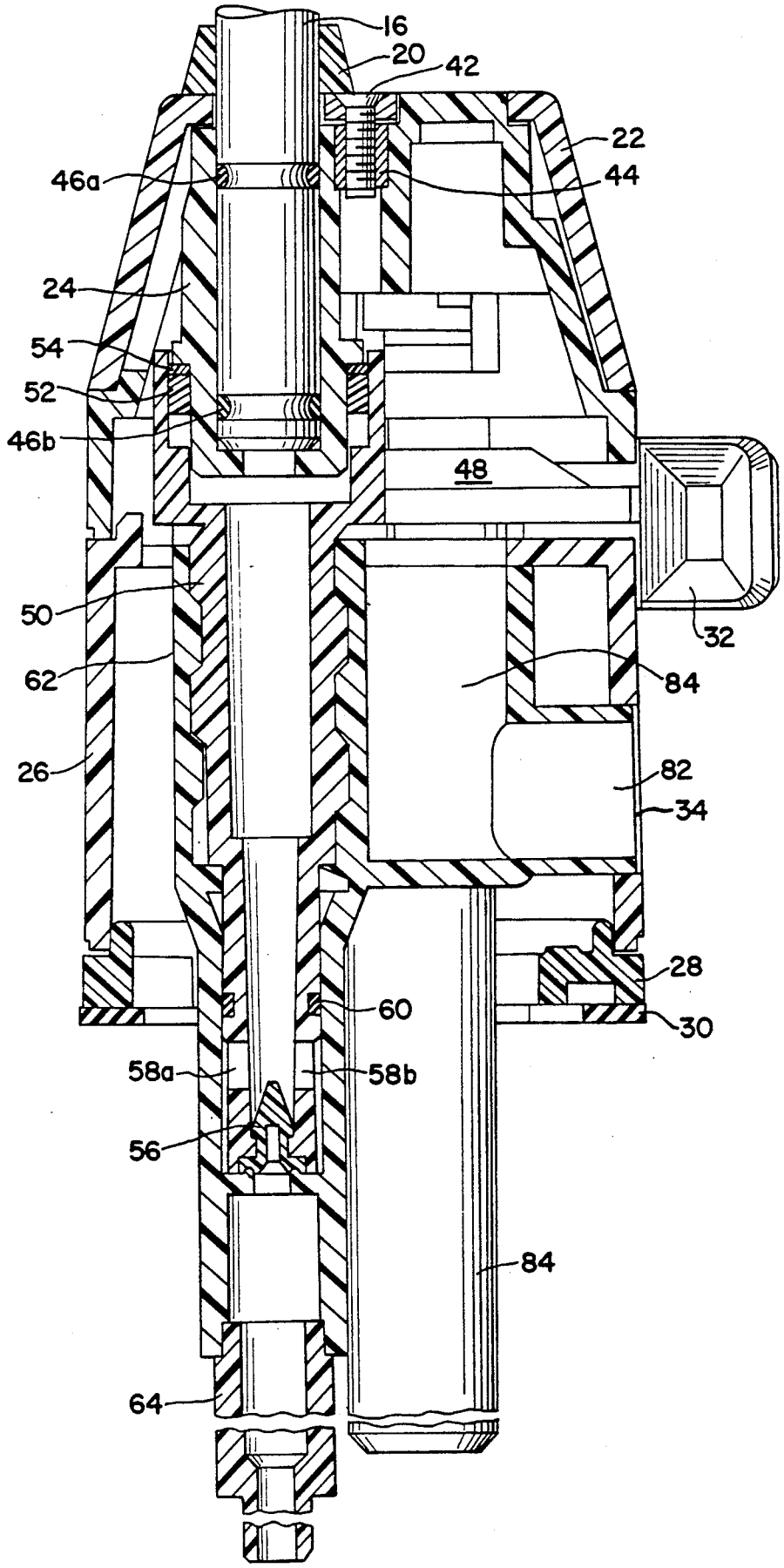
FIG. 3 is a cross-sectional view, taken along the plane of the line 3—3 of FIG. 2.
Figure 5:
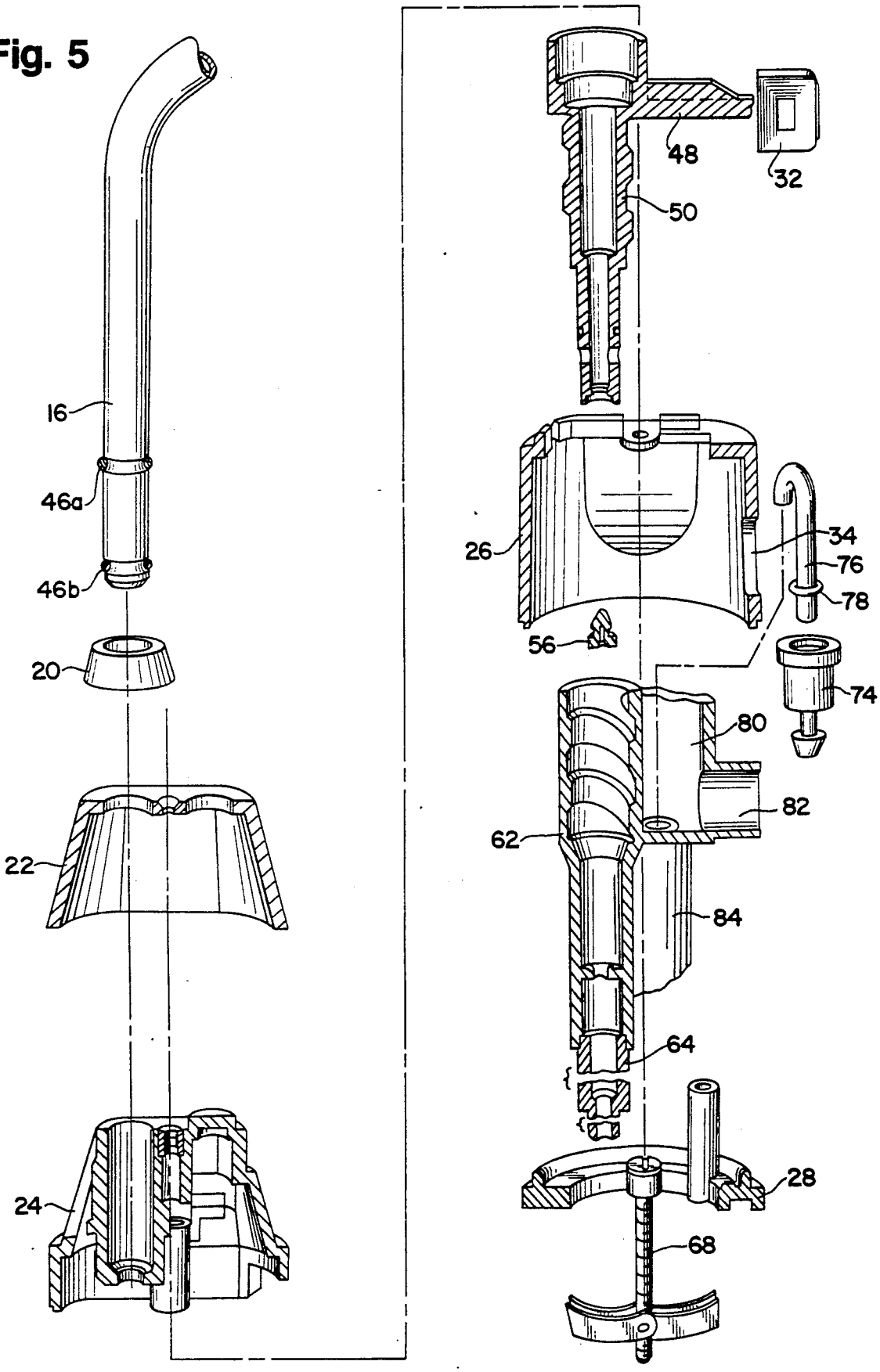
FIG. 5 is an exploded plan view, partly sectioned, showing several of the parts of the faucet of FIG. 1.

FIGS. 3–6 illustrate the parts constituting the faucet of the illustrative embodiment of the invention. Referring to FIGS. 3 and 5, the spout 16 and ferrule 20 are shown. The spout 16 is placed through an aperture in the outer body top 22 and in a channel in inner body top 24. The outer body top 22 is attached to the inner body top 24 by means of a screw 42 and a brass insert 44. Two grooves are formed near the proximal end of spout 16 into which are placed o-rings 46*a*, 46*b* which serve to hold the spout 16 in sealing relationship with the inner body top 24.

The operating handle 32 is attached to an arm 48 which is in turn attached to the valve stem 50. In the embodiment shown, the operating handle 32, arm 48, and valve stem 50 are a single molded piece. In order to seal the top of the valve stem 50, a "QUAD-BON" seal 52 and back-up ring 54 are placed between the valve stem 50 and the inner body top 24. "QUAD-BON" is a registered U.S. Trademark of Minnesota Rubber, Minneapolis, Minn. 55440, from whom "QUAD-BON" seals are commercially available.

A stem seat 56 is mounted in the lower end of the valve stem 50. There are two apertures 58*a*, 58*b* near the lower end of the valve stem 50 above which there is an o-ring 60 in a groove on the valve stem 50.

The valve stem 50 is mounted in inner body bottom 62. The inner body bottom 62 comprises a channel which is threaded at the top to accept the valve stem 50 and which has a circular aperture at its lower end surrounded by a raised circular bead against which the stem seat 56 may seal. There is an extension 64 on the inner body bottom 62 to which the treated water line from the water treatment apparatus is attached.

Referring to FIG. 4, the inner body bottom 62 is attached to the base 28 by means of a pair of screws 64 and brass inserts 66, only one pair being shown in the figures. The base 28 is placed on the gasket 30. The base 28 is attached to the mounting surface by means of a pair of toggle bolts 68, only one bolt being shown in the figures. The inner body top 24 is attached to inner body bottom 62 by means of a pair of screws 70 and brass inserts 72, only one pair being shown in the figures. These screws also serve to hold in place outer body bottom 26.

Figure 6:
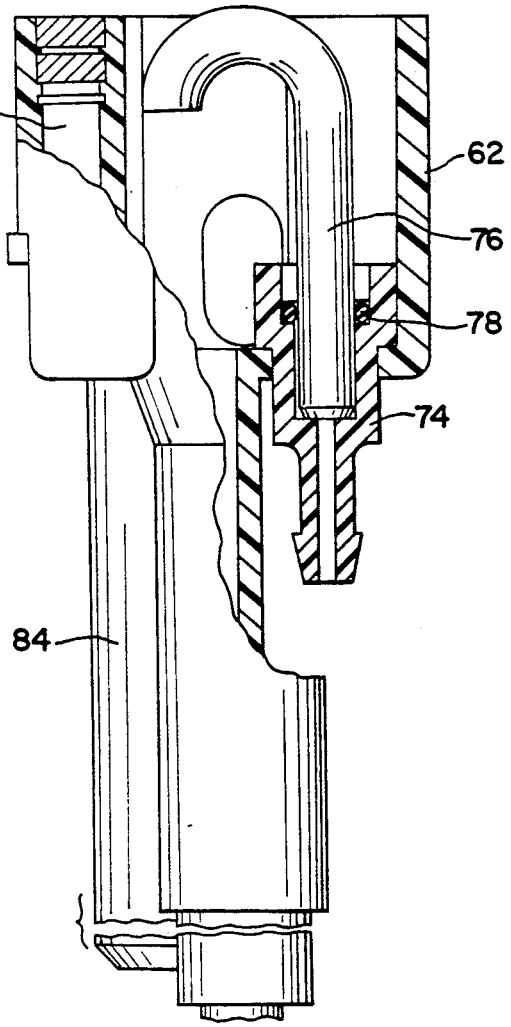
FIG. 6 is side plan view, partly in cross-section along the plane of line 6—6 of FIG. 2, of the inner body bottom of the faucet of FIG. 1.

Referring to FIGS. 5 and 6, the waste water line from the water treatment apparatus is attached to the waste water nipple 74 which is mounted in the inner body bottom 62. A drain spout 76 is mounted in the waste water nipple 74 with the aid of an o-ring 78. The drain spout 76 is located in air gap chamber 80 which opens into waste overflow/pressure releasing port 82 which is in turn open to the exterior of the faucet through air gap hole 34.

Waste water drains from air gap chamber 80 through an aperture in the inner body bottom 62 and into drain conduit 84 which has an inside diameter of about ⅜ inch. The outside diameter is preferably sized to accept tubing with a minimum inside diameter of one half inch. In this manner, gurgling of the air gap is prevented.

FIG. 7 is a base mounting tool 86 which may be used to mount the faucet from above the sink or other surface. The base mounting tool 86 is used to properly align the base 28 during installation and it prevents the arms of the toggle bolts from turning while the bolts are tightened. The base is aligned by placing the stem of the T-shaped aperture 88 on the base mounting tool 86 parallel with the rear of the sink.

Treated water enters the faucet by means of a conduit attached to extension 64 and moves upward and into the lower end of inner body bottom 62. Movement of the operating handle 32 causes the threaded valve stem 50 to rotate in the threaded channel in the inner body bottom 62, thus, lowering or raising stem seat 56. When the stem seat 56 is raised, treated water can flow upward through the aperture in the channel in the inner body bottom 62 and between the lower end of the valve stem 50 and the wall of the channel in the inner body bottom 62. The water may then enter apertures 58*a*, 58*b* in the valve stem 50 and flow upward through the center of the valve stem 50, through an aperture in the inner body top 24 and into and out of spout 16.

Although illustrative embodiments of the invention have been shown and described, however, it is to be understood that various modifications and substitutions may be made by those skilled in the art without departing from the novel spirit and scope of the present invention.

What is claimed is:

1. A water faucet of the type used with household water purification systems, which comprises:

an outer body defining a purified water passage therein;

a purified water inlet communicating with said purified water passage;

a valve within said purified water passage;

an inlet spout for said purified water;

said outer body defining a first aperture for receiving said outlet spout, said aperture communicating with said purified water passage;

a second aperture defined by said outer body for receiving said outlet spout, said second aperture being adapted for communication with said purified water passage, whereby said outlet spout can be introduced into said first aperture or said second aperture enabling the faucet to be mounted either in a left-handed or right-handed configuration.

2. A water faucet as defined by claim 1, including a handle for operating said valve, means operatively coupling said handle to said valve, said handle being slidable horizontally to move the valve from a closed position to an open position.

3. A water faucet as defined by claim 2, said outer body defining a horizontally disposed slot for receiving said handle and enabling said handle to be slid horizontally with respect to said outer body.

4. A water faucet as defined by claim 2, said valve comprising a threaded vertical tubular member having a valve seat that is engaged and disengaged in response to vertical movement of said tubular member, said handle being operative, when slid horizontally, to turn said tubular member causing it to move vertically.

5. A water faucet of the type used in household water purification systems, which comprises:

an outer body defining a purified water passage therein;

a purified water inlet communicating with said purified water passage;

a valve within said purified water passage;

an outlet spout for said purified water;

said outer body defining an aperture for receiving said outlet spout, said aperture communicating with said purified water passage;

said outer body having means for containing a water quality monitor;

said containing means comprising an opening defined by said outer body for receiving a water quality monitor visual display; and a second aperture defined by said outer body for receiving said outlet spout, said second aperture being adapted for communication with said purified water passage, whereby said outlet spout can be introduced into said first aperture or said second aperture, enabling the faucet to be mounted in either a left-handed or right-handed configuration; said opening defined by said outer body for receiving a water quality monitor being defined on only one face of said outer body.

6. A water faucet as defined by claim 5, including a handle for operating said valve, means operatively coupling said handle to said valve, said handle being slidable horizontally to move the valve from a closed position to an open position.

7. A water faucet as defined by claim 6, said outer body defining a horizontally disposed slot for receiving said handle and enabling said handle to be slid horizontally with respect to said outer body.

8. A water faucet as defined by claim 6, said valve comprising a threaded vertical tubular member having a valve seat that is engaged and disengaged in reponse to vertical movement of said tubular member, said handle being operative, when slid horizontally, to turn said tubular member causing it to move vertically.

9. A water faucet of the type used with household water purification systems, which comprises:

an outer body defining a purified water passage therein;

a purified water inlet communicating with said purified water passage;

a valve within said purified water passage;

an outlet spout for said purified water;

said outer body defining a first aperture for receiving said outlet spout, said aperture communicating with said purified water passage;

a handle for operating said valve;

means operatively coupling said handle to said valve;

said handle being slidable horizontally to move the valve from a closed position to an open position;

said outer body defining a horizontally disposed slot, for receiving said handle and enabling said handle to be slid horizontally with respect to said outer body;

said valve comprising a threaded vertical tubular member having a valve seat that is engaged and disengaged in response to vertical movement of said tubular member, said handle being operative, when slid horizontally, to turn said tubular member causing it to move vertically;

a waste water inlet coupled to said outer body;

a waste water outlet coupled to said outer body; and an air gap chamber coupling said waste water inlet to said waste water outlet.

10. A water faucet of the type used with household water purification systems, which comprises:

an outer body defining a purified water passage therein;

a purified water inlet communicating with said purified water passage;

a valve within said purified water passage;

an outlet spout for said purified water;

said outer body defining a first aperture for receiving said outlet spout, said aperture communicating with said purified water passage;

a handle for operating said valve;

means operatively coupling said handle to said valve;

said handle being slidable horizontally to move the valve from a closed position to an open position;

said outer body defining a horizontally disposed slot for receiving said handle and enabling said handle to be slid horizontally with respect to said outer body;

said valve comprising a threaded vertical tubular member having a valve seat that is engaged and disengaged in response to vertical movement of said tubular member, said handle being operative, when slid horizontally, to turn said tubular member causing it to move vertically;

said outer body having a water quality monitor visual display.

11. A water faucet of the type used with household water purification systems, which comprises:

an outer body defining a purified water passage therein;

a purified water inlet communicating with said purified water passage;

a valve within said purified water passage;

an outlet spout for said purified water;

said outer body defining a first aperture for receiving said outlet spout, said aperture communicating with said purified water passage;

a handle for operating said valve:

means operatively coupling said handle to said valve;

said handle being slidable horizontally to move the valve from a closed position to an open position;

said outer body defining a horizontally disposed slot for receiving said handle and enabling said handle to be slid horizontally with respect to said outer body;

said valve comprising a threaded vertical tubular member having a valve seat that is engaged and disengaged in response to vertical movement of said tubular member, said handle being operative, when slid horizontally, to turn said tubular member causing it to move vertically;

means for mounting said faucet from above a mounting surface, said mounting means comprising toggle bolts and a base mounting tool;

said base mounting tool including aligning means and means for preventing the arms on said toggle bolts from rotating while the toggle bolts are tightened and means for aligning the faucet.

* * * * *